US008197105B2

(12) United States Patent
Yang

(10) Patent No.: US 8,197,105 B2
(45) Date of Patent: Jun. 12, 2012

(54) LED-BASED LAMPS

(75) Inventor: Haitao Yang, San Jose, CA (US)

(73) Assignee: Intematix Corporation, Fremont, CA (US)

( * ) Notice: Subject to any disclaimer, the term of this patent is extended or adjusted under 35 U.S.C. 154(b) by 0 days.

(21) Appl. No.: 12/852,760

(22) Filed: Aug. 9, 2010

(65) Prior Publication Data

US 2011/0058353 A1 Mar. 10, 2011

Related U.S. Application Data

(63) Continuation of application No. 61/233,767, filed on Aug. 13, 2009.

(51) Int. Cl.
*F21V 7/00* (2006.01)

(52) U.S. Cl. ..... 362/346; 362/249.02; 362/297; 362/247; 362/217.05

(58) Field of Classification Search ..... None
See application file for complete search history.

(56) References Cited

U.S. PATENT DOCUMENTS

| | | | | |
|---|---|---|---|---|
| 4,035,085 | A | 7/1977 | Seiner | |
| 4,584,631 | A | 4/1986 | Cody et al. | |
| 5,998,925 | A | 12/1999 | Shimizu | |
| 7,237,925 | B2 * | 7/2007 | Mayer et al. | 362/247 |
| 7,311,858 | B2 | 12/2007 | Wang | |
| 7,390,437 | B2 | 6/2008 | Dong | |
| 7,575,697 | B2 | 8/2009 | Li | |
| 7,601,276 | B2 | 10/2009 | Li | |
| 7,604,384 | B2 * | 10/2009 | Peck | 362/517 |
| 2006/0158090 | A1 | 7/2006 | Wang et al. | |
| 2007/0029526 | A1 | 2/2007 | Cheng et al. | |
| 2007/0081780 | A1 | 4/2007 | Scholl | |
| 2007/0153526 | A1 | 7/2007 | Lim | |
| 2007/0240346 | A1 | 10/2007 | Li et al. | |
| 2007/0274096 | A1 * | 11/2007 | Chew et al. | 362/609 |
| 2007/0297179 | A1 * | 12/2007 | Leung et al. | 362/296 |
| 2008/0111472 | A1 | 5/2008 | Liu et al. | |
| 2008/0192458 | A1 | 8/2008 | Li | |
| 2008/0204888 | A1 * | 8/2008 | Kan et al. | 359/629 |
| 2008/0218993 | A1 | 9/2008 | Li | |
| 2009/0101930 | A1 | 4/2009 | Li | |
| 2009/0168428 | A1 * | 7/2009 | Huang | 362/294 |
| 2009/0283721 | A1 | 11/2009 | Liu et al. | |
| 2009/0296383 | A1 * | 12/2009 | Valster et al. | 362/231 |
| 2009/0316414 | A1 * | 12/2009 | Yang et al. | 362/296.01 |
| 2010/0172152 | A1 * | 7/2010 | Boonekamp | 362/609 |

OTHER PUBLICATIONS

International Search Report and Written Opinion dated Oct. 21, 2010 for International Application No. PCT/US2010/045074, 10 pages.

* cited by examiner

*Primary Examiner* — Laura Tso
(74) *Attorney, Agent, or Firm* — Fliesler Meyer LLP

(57) ABSTRACT

An LED-lamp (lighting bar) comprises a plurality of solid state light emitters (LEDs) configured as an elongate (linear) array and a generally concave cylindrical light reflective surface disposed along the length of the array of LEDs. The concave light reflective surface is configured to direct light over an illumination plane located to a side of the lamp. The LEDs can be configured such that their emission axes are oriented to the illumination plane at an angle of between 0° and 90. The lamp can further comprise a second generally concave cylindrical light reflective surface in which the concave light reflective surfaces are configured to direct light over illumination planes located on respective sides of the lamp. There is also disclosed a panel lamp and sign incorporating the lamp(s) of the invention.

27 Claims, 14 Drawing Sheets

LED-BASED LAMPS

CLAIM OF PRIORITY

This application claims the benefit of priority from U.S. Provisional Patent Application No. 61/233,767 filed Aug. 13, 2009 by Haitao Yang entitled "Solid State Light Emitter Based Lamp", the specification and drawings of which are incorporated herein by reference.

BACKGROUND OF THE INVENTION

1. Field of the Invention

This invention relates to LED-based (Light Emitting Diode-based) lamps and in particular, although not exclusively, to linear lighting bars for use in a display cabinet or refrigerated cabinet. The invention further concerns a panel lamp and light emitting sign utilizing one or more such lamps.

2. Description of the Related Art

White light emitting LEDs ("white LEDs") are known in the art and are a relatively recent innovation. It was not until high brightness LEDs emitting in the blue/ultraviolet (U.V.) part of the electromagnetic spectrum were developed that it became practical to develop white light sources based on LEDs. As taught, for example in U.S. Pat. No. 5,998,925, white LEDs include one or more phosphor materials, that is photo-luminescent materials, which absorb a portion of the radiation emitted by the LED and re-emit radiation of a different color (wavelength). Typically, the LED chip generates blue light and the phosphor material(s) absorbs a percentage of the blue light and re-emits yellow light or a combination of green and red light, green and yellow light or yellow and red light. The portion of the blue light generated by the LED that is not absorbed by the phosphor material combined with the light emitted by the phosphor material provides light which appears to the eye as being nearly white in color.

Due to their long operating life expectancy (>50,000 hours) and low power consumption high brightness white LEDs are increasingly being used to replace conventional light sources such as fluorescent, compact fluorescent and incandescent bulbs. Today, most lighting fixture designs utilizing white LEDs comprise systems in which a white LED (more typically an array of white LEDs) replaces the conventional light source component. Moreover, due to their compact size, compared with conventional light sources, white LEDs offer the potential to construct compact lighting fixtures.

SUMMARY OF THE INVENTION

The present invention arose in an endeavor to provide a compact lamp based on solid state light emitters, typically LEDs, which is able to generate a substantially uniform light emission over an illumination plane.

According to the invention a lamp comprises a plurality of solid state light emitters configured as an elongate array and a first generally concave cylindrical light reflective surface disposed along the length of the array of light emitters and configured to direct light over a first illumination plane located to a side of the lamp. Typically the light emitters are configured as a linear array in which they are equally spaced along a straight line though other elongate arrays will be apparent to those skilled in the art including two dimensional elongate arrays. For ease of fabrication the generally concave light reflective surface can be multi-faceted. Alternatively it can comprise a continuously curved surface or a combination of contiguous surfaces. The light reflective surface can be further configured to prevent at least in part direct emission of light from the light emitters from the lamp.

For lamps in accordance with the invention the light emitting devices can be configured such that their emission axis is oriented to the illumination plane at an angle of between 0° and 90°, that is the light emitting devices can be oriented ranging from their light emission axis being substantially parallel with the illumination plane to being orthogonal to the illumination plane.

The lamp can further comprise a second generally concave cylindrical light reflective surface in which the concave light reflective surfaces are configured to direct light over an illumination plane located on respective sides of the lamp. In such arrangements in which the light emitting devices are configured with their emission axis substantially orthogonal to the illumination plane the concave light reflective surfaces can abut to form a ridge which is configured to extend toward and overlay the array of light emitters. Generally in such an arrangement the light reflective surfaces are configured to direct light over the illumination plane that is located on the same side of the array of light emitters. In a further arrangement each concave light reflective surface comprises a convex portion and the two convex portions abut to form a channel which is positioned overlying the array of light emitters. Generally in such an arrangement the light reflective surfaces are configured to direct light over the illumination plane that is located on the opposite side of the array of light emitters. To ensure substantially the same illumination over each illumination plane the concave and/or convex light reflective surfaces are preferably the same and arranged symmetrically on either side of the array of light emitters.

In arrangements in which the light emitting devices are configured with their emission axis substantially parallel with the illumination plane the lamp can comprise a respective array of light emitting devices that are configured to emit light in opposite directions. Generally in such arrangements the light reflective surfaces are configured to direct most of the light over the illumination plane on the same side as the array of light emitters. To reduce a dark region along the length of the lamp the light reflective surfaces can further comprise a portion configured to direct light towards the illumination plane on the opposite side of the array of light emitters.

Preferably the concave light reflective surface(s) is/are configured such that a variation in luminous emission intensity over the illumination plane(s) is less than 20% and preferably less than 10%.

In one arrangement the lamp comprises an elongate channel shaped body in which the light emitters are located and spaced along the length of the body. The concave light reflective surface can comprise an integral part of the body such as for example an inner surface of a base and/or wall portion of the body. Alternatively, the concave light reflective surface can extend between base and wall portions of the body. The body preferably comprises a thermally conductive material such as aluminum and the light emitters are mounted in thermal communication with the body to aid in dissipating heat generated by the light emitters.

The lamp can further comprise a substantially convex light reflective cylindrical surface located within the body that extends along the second wall portion and is configured such that in operation the convex light reflective surface in conjunction with the concave light reflective surface emit light over the illumination plane.

To maximize the lamp's luminous efficacy the light reflective surfaces are as light reflective as possible and have a reflectance of at least 90%, preferably at least 95% and more preferably at least 98%. The reflective surfaces can comprise a polished surface, a metallization layer of for example aluminum, silver or chromium or a white surface such as a painted surface or a high reflectivity paper.

Whilst the invention arose in relation to a lighting bar for a display cabinet or refrigerated cabinet where the aspect ratio of the lamp is at least 4:1 (illumination width: distance of lamp from illumination plane) the lamp of the invention is suitable for use in other applications where it is required to provide a uniform illumination over an illumination plane that is located in close proximity to the lamp such as for example as a part of a light emitting panel lamp or lighting of other planar surfaces such as signage.

According to a further aspect of the invention a panel lamp comprises an enclosure incorporating at least one lamp in accordance with the invention. The lamp(s) can be configured to emit light towards the base of the enclosure. Alternatively the lamp(s) can be configured to emit light towards the enclosure opening. The panel lamp can further comprise a light reflective surface on the base of the enclosure for reflecting light out through the enclosure opening which constitutes a light emission plane of the panel lamp. Advantageously, the light reflective surface on the base of the enclosure further comprises a light scattering surface, such as for example a white surface, such as to randomize the angle at which light is reflected from the surface and to optimize the emission uniformity from the panel lamp. Preferably, the enclosure is quadrilateral in form, square or rectangular, and a respective lamp is located along opposite walls of the enclosure. Additionally the panel lamp can comprise one or more lamp located between the walls that emit light over an illumination plane located on opposite sides of the lamp. In one arrangement the light reflective surface comprises a convex cylindrical surface that extends between the walls of the enclosure along which the lamps (lighting bars) extend. In a further arrangement the light reflective surface comprises a substantially planar surface that extends between the walls of the enclosure at which the lamps are located.

Advantageously, the panel lamp further comprises at least one phosphor material provided at the enclosure opening that is operable to absorb at least a portion of light emitted by the light emitters and to emit light of a different wavelength range. An advantage of providing the phosphor material physically remote to the LEDs (rather than incorporating it within the light emitters) is that light generation, photo-luminescence, occurs over a larger surface area and this can result in a more uniform color and/or CCT (correlated color temperature) of emitted light. A further advantage of locating the phosphor material remote to the LEDs is that less heat is transferred to the phosphor material(s), reducing thermal degradation of the phosphor material(s).

In one arrangement the at least one phosphor material is incorporated in a light transmissive window that overlays the enclosure opening. The light transmissive window can comprise a polymer material such as for example a polycarbonate, acrylic, silicone, epoxy material or a low temperature glass. Where the window comprises a polymer material the powdered phosphor material(s) can be mixed with the polymer material and the phosphor/polymer mixture then formed into a sheet of uniform thickness having a uniform (homogeneous) distribution of phosphor material throughout its volume. The weight ratio loading of phosphor to polymer is typically in a range 35 to 85 parts per 100 with the exact loading depending on the required color and/or CCT of the emission product of the panel lamp. As in the case of the weight loading of the phosphor material to polymer, the thickness of the phosphor loaded window will determine the color and/or CCT of light generated by the lamp. An advantage of providing the phosphor material as a part of a window enables the color and/or CCT of the panel lamp to be changed by changing the phosphor/polymer window.

In an alternative arrangement the at least one phosphor material is provided as one or more layers on at least a part of the surface of the light transmissive window. Conveniently the phosphor material is screen printed on the light transmissive window to form a layer of uniform thickness. The light transmissive window can comprise a polymer material such as for example a polycarbonate, acrylic, silicone, epoxy material or a low temperature glass.

Due to the isotropic nature of phosphor photoluminescence approximately half of the light generated by the phosphor material(s) will be emitted in a direction back into the volume of the enclosure. Such light will be reflected by the light reflective surface on the base of the enclosure and eventually emitted out of the panel lamp. To increase overall light emission from the panel lamp the phosphor material can patterned on the window such as to include a pattern of areas with no phosphor material which are transmissive to light generated by the light emitters and light generated by the phosphor. Such areas enable both light emitted by the light emitters and emitted by the phosphor material(s) to be more readily emitted from the panel lamp. The phosphor material(s) can for example be provided as a checkered pattern, as a square array of square shaped phosphor regions that are separated from one another other by a window in the form of a square grid or as a layer covering the entire surface of the light transmissive window and which includes a regular array (e.g. square or hexagonal array) of circular or other shaped windows. Other phosphor/window patterns will be apparent to those in the art.

It is envisaged that the panel lamp of the invention will be used in general lighting applications where the emitted light emitted will comprise a combination of light emitted by the light emitters and at least one phosphor material and will appear white in color. Typically the light emitters emit light having a dominant wavelength in a range 430 to 480 nm (blue) and the at least one phosphor material emits light with a dominant wavelength in a range 555 to 585 nm (yellow). To improve the CRI (Color Rendering Index) of emitted light the lamp preferably comprises two or more phosphor materials that are operable to emit light having a dominant wavelength in different parts of the spectrum typically green (490 to 550 nm) and red (600 to 780 nm) regions. Alternatively, the light emitters can comprise a combination of blue and red light emitting LEDs.

Alternatively, the light emitters can comprise white LEDs that are operable to emit light that appears white in color.

The light transmissive window can be planar in form. Alternatively it is envisaged that the light transmissive window be arcuate in form.

According to a further aspect of the invention a light emitting sign comprises a display surface and at least one lamp and/or panel lamp according to the invention that is configured to illuminate the display surface. The display surface will typically be light transmissive though it can comprise a light reflective surface. In a preferred implementation the sign further comprises at least one phosphor material located on the display surface that is operable to absorb at least a portion of light emitted by the light emitters and to emit light of a different wavelength range. In one configuration the display surface is light transmissive and the at least one phosphor material is provided as one or more layers on the display surface. The phosphor material can be configured to be representative of display information such as a numeral, letter, device insignia, indicia, symbol etc.

BRIEF DESCRIPTION OF THE DRAWINGS

In order that the present invention is better understood LED-based lamps and a light emitting sign based on lamps in accordance with embodiments of the invention will now be described, by way of example only, with reference to the accompanying drawings in which.

DETAILED DESCRIPTION OF THE INVENTION

Figure 1:
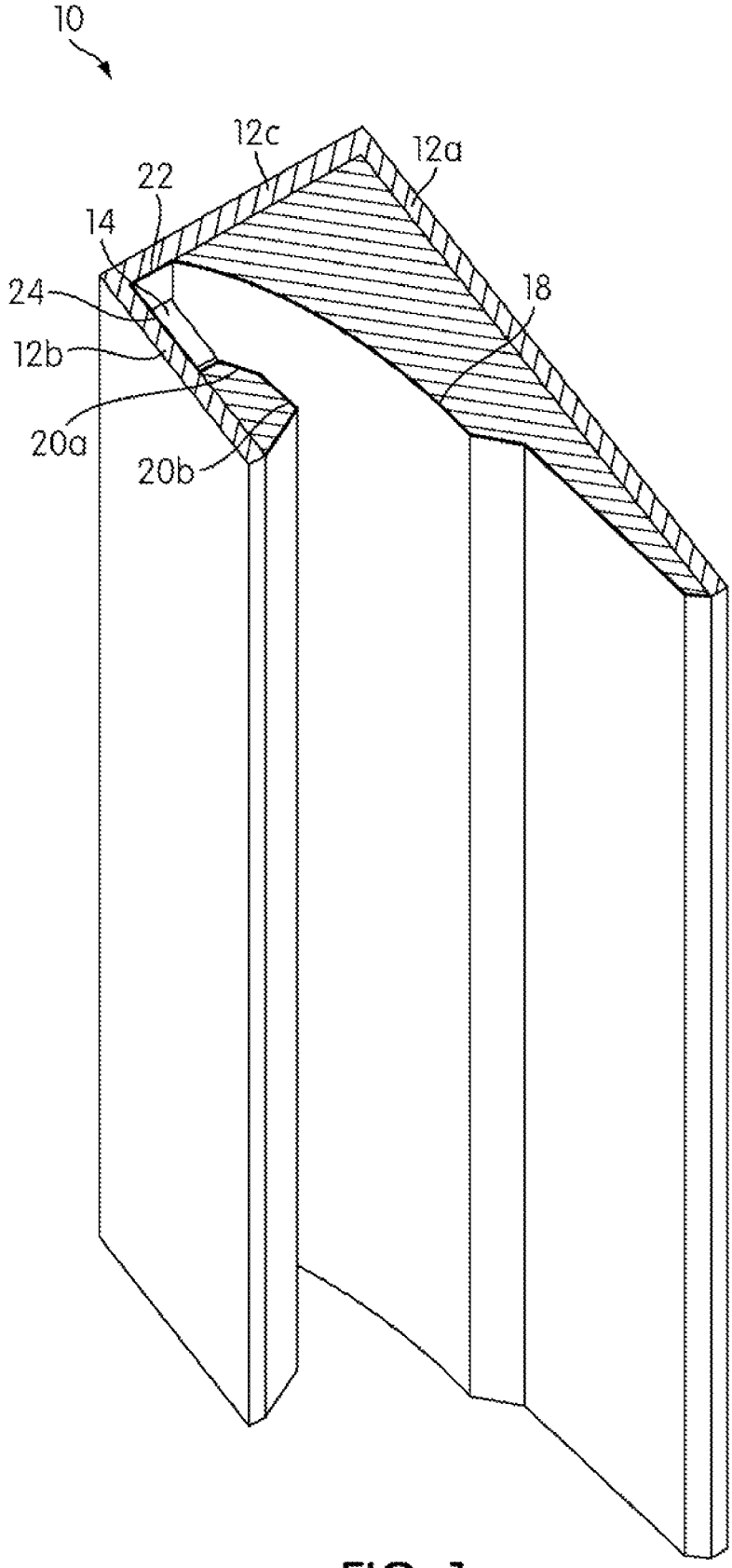
FIG. 1 is a perspective schematic of an LED-based lamp in accordance with an embodiment of the invention.

Embodiments of the invention are directed to solid state light emitter (typically LED) based lamps in the form of an elongate light emitting bar (lighting bar) that produce a generally uniform illumination over at least one illumination plane located to a side of the lamp. Lamps of the invention comprise a plurality of solid state light emitters configured as an elongate array and a light reflective surface (e.g. a concave generally cylindrical light reflective surface) disposed along the length of the array of light emitting devices. The light reflective surface is configured to direct light over the illumination plane located to a side of the lamp. Additionally the light reflective surface can be configured to prevent, at least in part, direct emission of light from the light emitters. The light emitting devices can be configured such that their emission axes are oriented to the illumination plane at an angle of between 0° and 90° that is the light emitting devices can be oriented ranging between their light emission axis being substantially parallel with the illumination plane and being orthogonal to the illumination plane. Typically the aspect ratio of the lamp is at least 4:1 (illumination width: distance of lamp from illumination plane) more typically at least 5:1 making the lamp ideally suited in applications where the lighting space is limited such as lighting within a refrigerated display cabinet as are commonly used in the retail of refrigerated goods. The lamps of the invention are also suitable as part of a low profile panel lamp.

In this specification like reference numerals are used to denote like parts.

Figure 2:
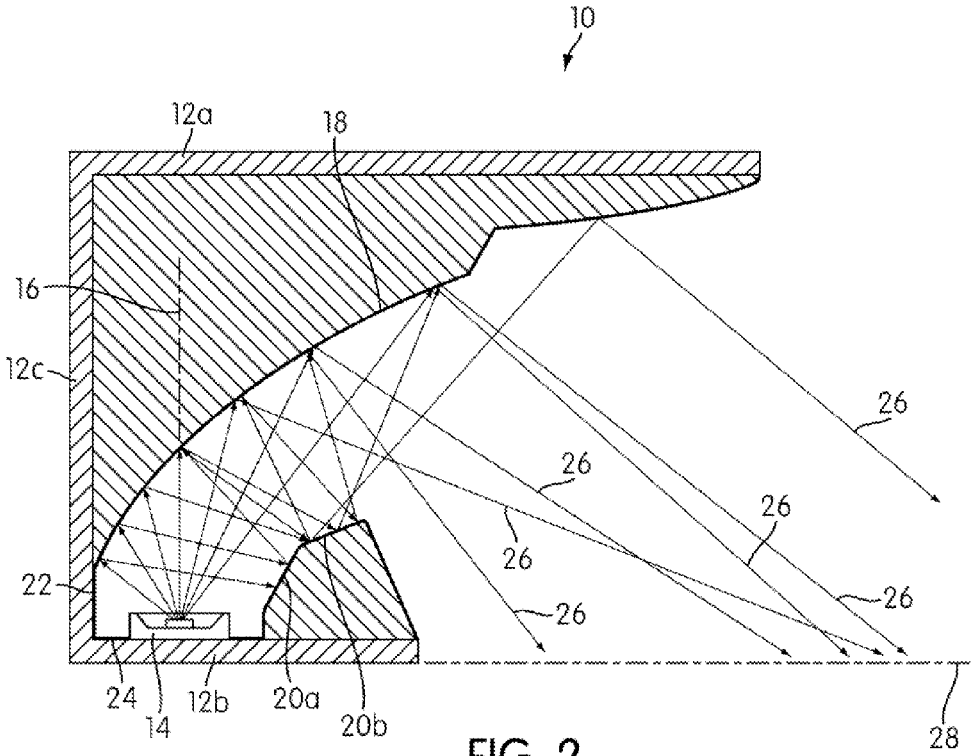
FIG. 2 is a sectional schematic of the lamp of FIG. 1.

An LED-based lamp 10 in accordance with an embodiment of the invention is now described with reference to FIGS. 1 and 2 in which FIG. 1 is a schematic perspective view of the lamp 10 and FIG. 2 is a schematic sectional view of the lamp. The lamp 10 is in the form of an elongate lighting bar and is configured to generate white light with a Correlated Color Temperature (CCT) of ≈3000K and an emission luminous intensity of order 400 lumens (lm). The lamp 10 is intended to be used along the walls or shelves of for example an open fronted retail display cabinet or a refrigerated cabinet of a type with a light transmissive door to enable viewing of the contents.

The lamp 10 comprises an elongate shaped body 12 that is preferably fabricated from a thermally conductive material such as an extruded aluminum channel. In the example shown the body 12 comprises a channel of a generally U-shaped section with parallel walls 12*a*, 12*b* and a base 12*c*. As shown the wall 12*a* is approximately twice the depth of the other wall 12*b*. As illustrated in FIG. 2 the lamp 10 further comprises a plurality (ten in this example) 1 W (≈40 lm emission luminous intensity) white light emitting GaN (gallium nitride) based white LEDs 14 that are positioned along the inner surface of the wall 12*b* in proximity to the base 12*c*. For ease of fabrication and electrical connection, the LEDs 14 are typically mounted on a substrate (not shown), such as a metal core printed circuit board (MCPCB), which is then mounted to the inner surface of the wall 12*b*. The substrate is preferably mounted in thermal communication with the body to aid in dissipating heat generated by the LEDs by transferring it to the relatively larger thermal mass of the body 12. In the example shown the LEDs 14 are configured as a single linear array with the LEDs 14 being equally spaced along the length of the body 12 and are oriented such that their axis of emission 16 is orthogonal to the wall 12*b*. It will be appreciated that the LEDs can be arranged in other elongate arrays.

A concave cylindrical light reflective surface (concave cylindrical mirror) 18 is provided within the body 12 and comprises a generally arcuate surface that extends between the end of the wall 12*a* and base 12*c*. The concave light reflective surface 18 can be multifaceted and comprise a series of contiguous planar surfaces or one or more smooth (continuously curved) surfaces or a combination thereof. In FIGS. 1 and 2 all light reflective surfaces are indicated by heavier solid lines.

A convex cylindrical light reflective surface (convex cylindrical mirror) 20 is provided on the wall 12*b* and comprises a generally arcuate surface that extends from the wall 12*b* in general proximity to the LEDs to the end of the wall 12*b*. As shown the light reflective surface can comprise a series of contiguous planar surfaces 20*a*, 20*b*. In alternative arrangements it can comprise one or more continuously curved surfaces. To maximize emission of light from the lamp all inner surfaces of the body 12 are preferably mirrored (light reflective) 22, 24.

Each of the light reflective (mirrored) surfaces 18, 20, 22, 24 can comprise a metallization layer of for example aluminum, silver or chromium or a white painted surface. The reflectance of the light reflective surfaces is as high as possible and is preferably greater than 90%, typically greater that 95% and more preferably greater than 99%.

In FIG. 2 lines 26 indicate examples of light paths by which light is emitted from the lamp 10. For ease of understanding only light paths are indicated in FIG. 2 that lie in a plane that is mutually orthogonal to the wall 12*a* and base 12*c* though it will be appreciated that due to the radial emission pattern of the LEDs 14 other paths exist. As indicated in FIG. 2 the light reflective surfaces 18, 20 are configured such that together they direct light such that it is emitted from the lamp substantially uniformly over an illumination plane 28 that is parallel with the walls 12*a*, 12*b* (i.e. the emission axis 16 of the LEDs is orthogonal to the illumination plane 28). Additionally, the light reflective surfaces 18 and 20 together prevent direct emission of light from the LEDs. Initial tests indicate that by careful configuration of the light emitting surfaces 18, 20 the variation in luminous intensity across the light illumination plane 28 is typically less than ±10% and that less than ±8% should be achievable. Moreover, of order of at least 90% of the total generated light is emitted from the lamp 10. Since the lamp 10 emits light over an illumination plane 28 located along one edge (side) of the lamp, the lamp will be referred to as an edge (side) emitting lamp or edge lighting bar.

Figure 3:
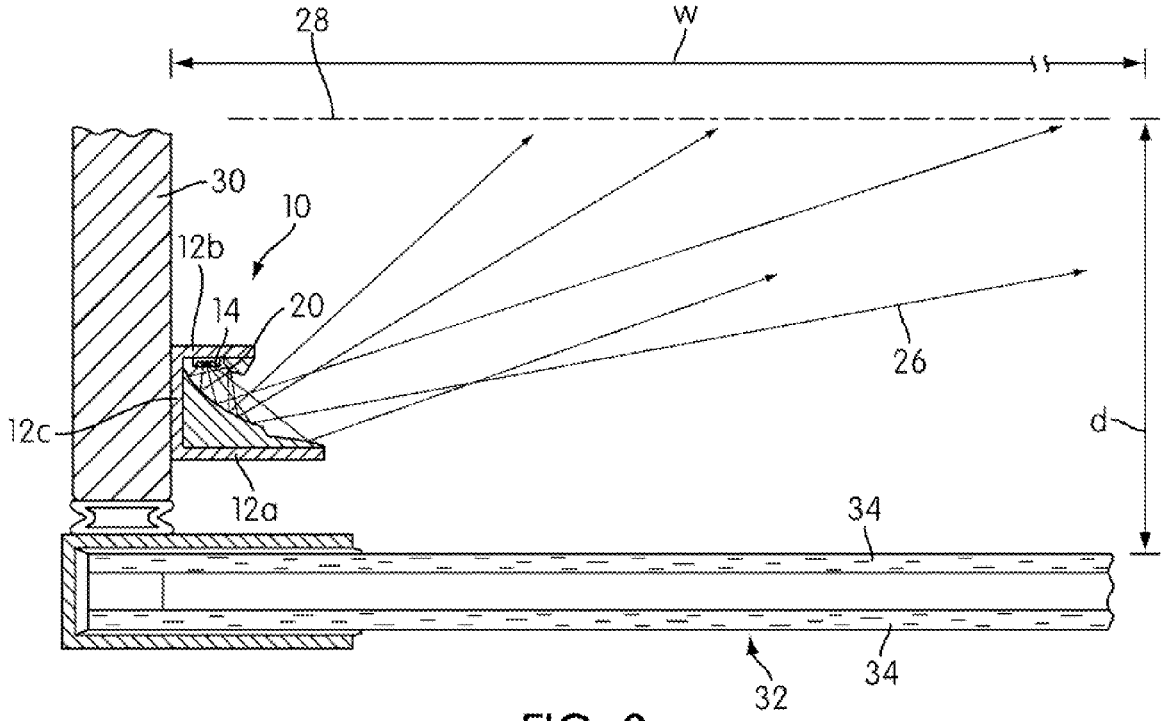
FIG. 3 is a sectional plan view of part of a refrigerated display cabinet showing an example of placement of the lamp of FIG. 1.

Referring to FIG. 3 there is shown a sectional plan view of a part of a refrigerated cabinet incorporating the edge lighting bar 10 of the invention. As shown the lighting bar is configured such that the base 12*c* of the lighting bar is in proximity to the wall 30 such that the lamp produces a uniform illumination across the width "w" of the cabinet at the illumination plane 28. Refrigerated/frozen products are located at or beyond the illumination plane 28 at a distance of at least "d" from the front of the cabinet. To maximize the number of products that can be stored and lit in the cabinet requires the distance "d" to be as short as possible and preferably less than between 6" (inches) and 8". Thus for a cabinet of width w=30" the lamp has an aspect ratio of between 5:1 and 4:1. As shown the refrigerated cabinet has a door 32 with a dual pane window 34 to enable the products to be viewed without having to open the refrigerated cabinet.

Figure 4:
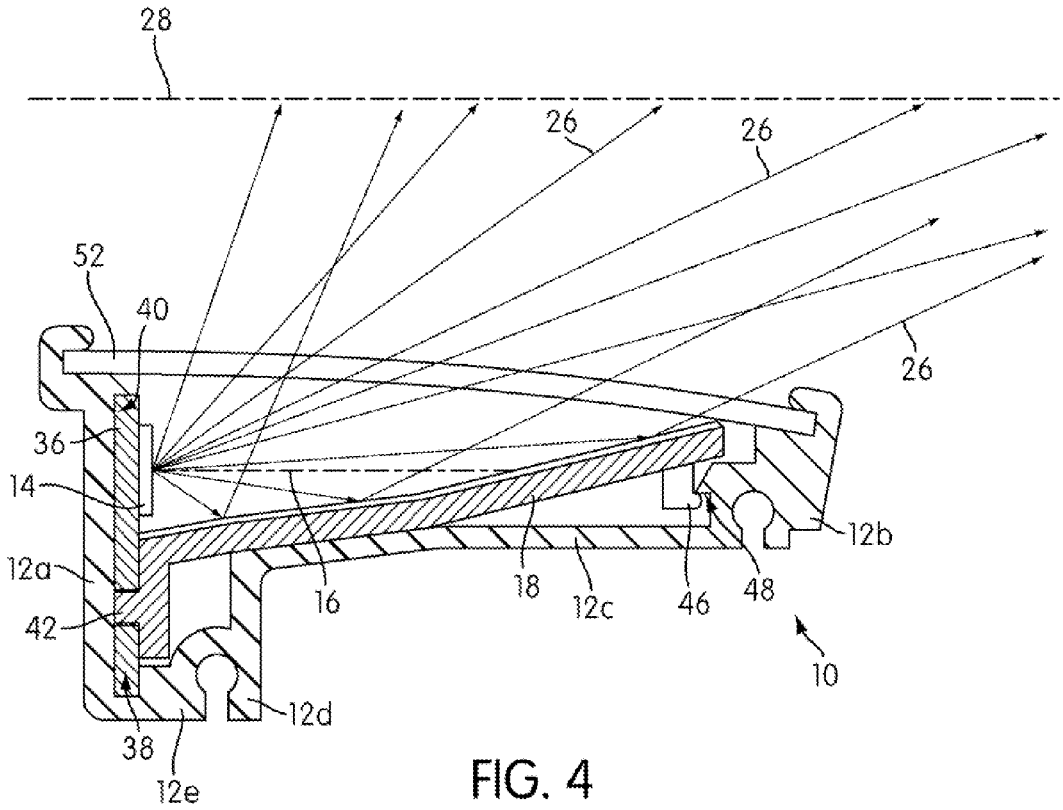
FIG. 4 is a sectional view through A-A of an LED-based lamp in accordance with a further embodiment of the invention.
Figure 5:
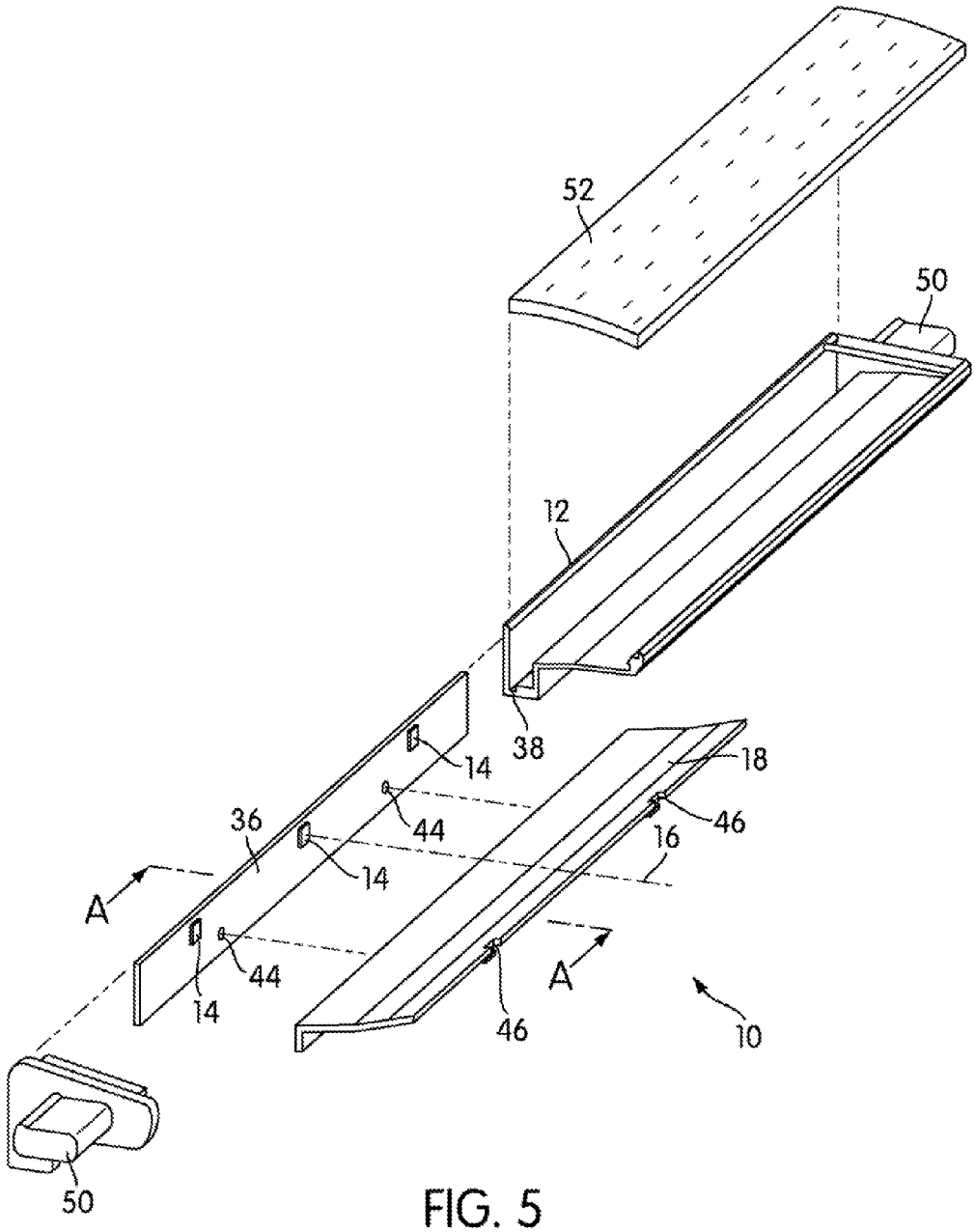
FIG. 5 is an exploded perspective view of the lamp of FIG. 4.

FIGS. 4 and 5 respectively show a sectional view and an exploded perspective view of an LED-based lamp (edge lighting bar) 10 in accordance with a further embodiment of the invention. In this embodiment the array of LEDs 14 are configured such that the emission axis 16 of each LED is parallel with the illumination plane 28. Referring to FIG. 4 the body 12 comprises an extruded aluminum section that is a shallow generally U-shaped in form with walls 12*a* and 12*b* connected by a base 12*c*. The body 12 additionally comprises a deeper U-shaped channel defined by a wall 12*d* extending from the base 12*c* and connected to the wall 12*a* by a base portion 12*e*. As will be further described the deeper channel is used for mounting the LEDs 14 and reflector 18 within the body 12. The LEDs 14 can be mounted on a strip of MCPCB 36 which is mounted against the inner surface of the wall 12*a* and held in position between a slot 38 in the base portion 12*e* and a lip 40 at the top of the side 12*a*. As is best seen in FIG. 5 the MCPCB 36 can be inserted into the body by sliding the MCPCB 36 into the open end of the body.

The light reflective surface 18 which comprises a shallow generally concave surface, as indicated by the heavier line in FIG. 4, can comprise ABS (Acrylonitrile Butadiene Styrene), a polycarbonate, an acrylic or other polymer material and advantageously has a surface metallization to maximize its reflectivity. Alternatively the light reflective surface can comprise a material such as aluminum, an aluminum alloy or magnesium alloy. As shown the light reflective surface 18 can include pegs 42 that are configured to engage in corresponding through holes 44 in the MCPCB 36 for mounting the light reflective surface in the body. Having inserted the MCPCB 36 into the body the light reflective surface 18 can be inserted into the body such that the pegs 42 engage in the through holes 44 in the MCPCB 36 and held in place by resiliently deformable lugs 46 that clip under a lip 48 in the wall 12*b* body. The lamp 10 can further comprise end caps 50 and a light transmissive cover 52 to reduce the ingress of moisture into the lamp and to enable the lamp to be more readily cleaned.

Figure 6:
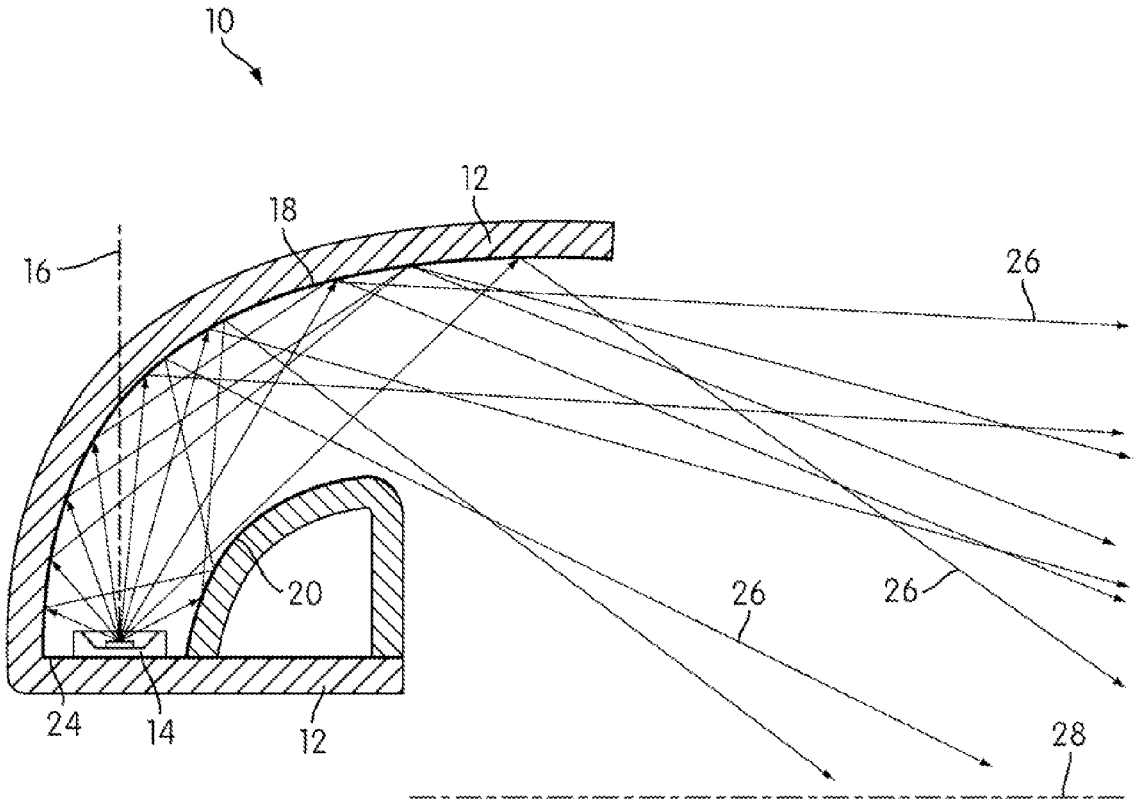
FIG. 6 is a sectional schematic of an LED-based lamp in accordance with a another embodiment of the invention.

FIG. 6 is a sectional schematic of an LED-based lamp (edge lighting bar) 10 in accordance with another embodiment of the invention. In this embodiment the inner surface of the body 12 constitutes the concave light reflective surface 18. As can be seen in FIG. 6 the concave light reflective surface 18 comprises a continuously curved cylindrical surface. The convex light reflective surface 20 can, as shown, comprise a separate component to the body 12 or be formed as an integral part of the body.

Figure 7:
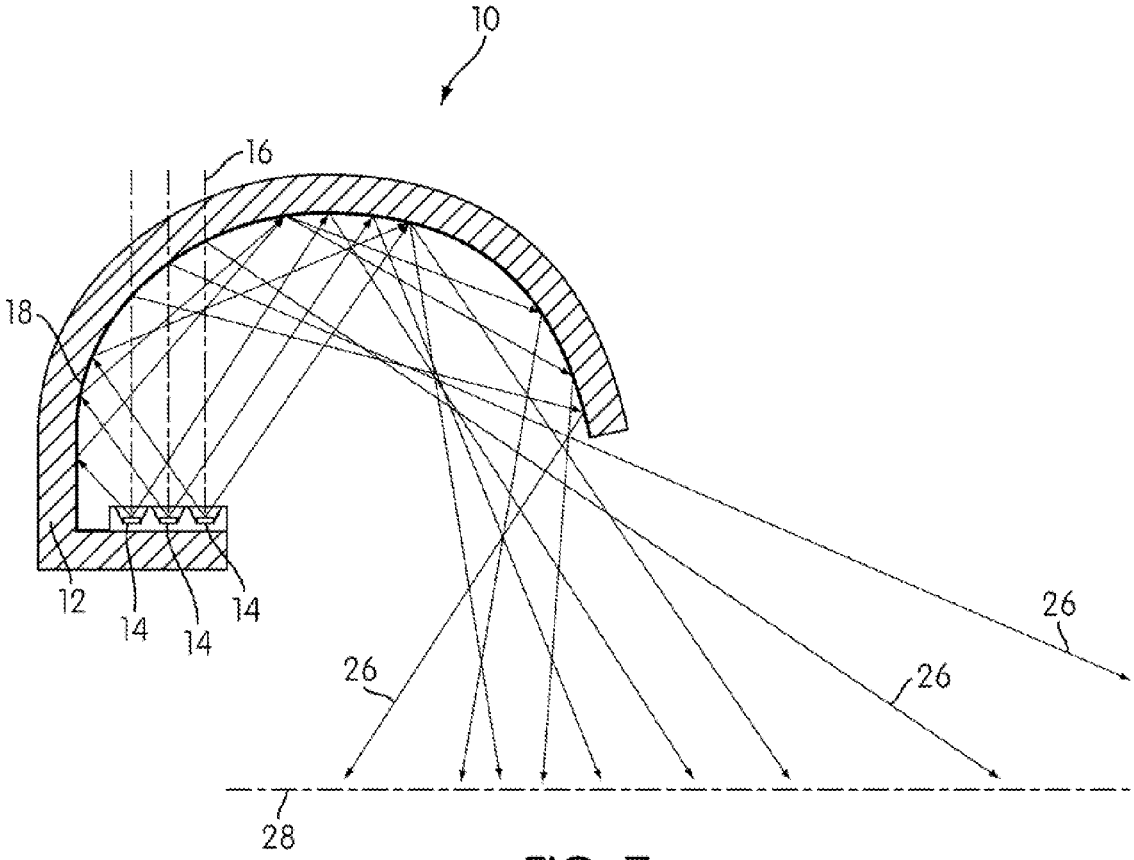
FIG. 7 is a sectional schematic of an LED-based lamp in accordance with a yet further embodiment of the invention.

FIG. 7 is a sectional schematic of an LED-based lamp (edge lighting bar) 10 in accordance with yet another embodiment of the invention. Like the embodiment of FIG. 6 the inner surface of the body 12 constitutes the concave light reflective surface 18. As can be seen in FIG. 7 the LEDs 14 each comprise a packaged array of LED chips and the concave light reflective surface comprises a multi-faceted cylindrical surface. It will be appreciated that the light reflective surface can alternatively comprise a continuously curved cylindrical surface or a combination of continuously curved and one or more planar surfaces. By careful configuration of the geometry of the concave light reflective surface 18 the convex light reflective surface 20 is no longer required.

Figure 8:
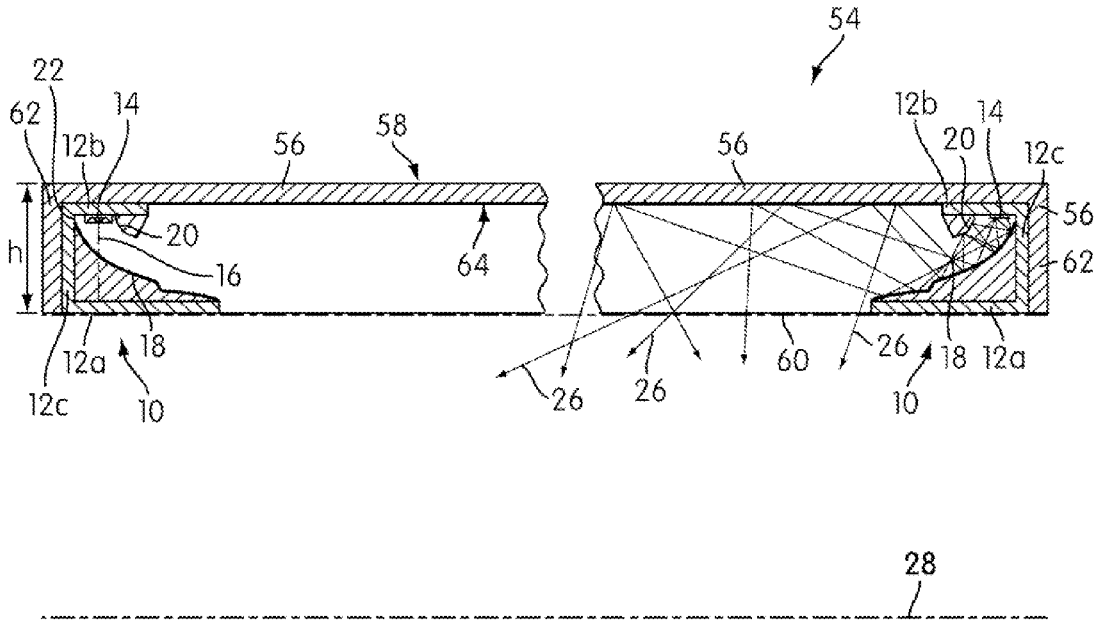
FIG. 8 is sectional schematic of a light emitting panel lamp incorporating the lamp of FIG. 1.

Whilst the invention arose in relation to an edge lighting bar for a display cabinet or refrigerated cabinet, the lamp of the invention is suitable for use in other applications such as for example as a part of a light emitting panel lamp or lighting of other planar surfaces such as signage. FIG. 8 is a sectional schematic of a light emitting panel lamp 54 based on the edge lighting bars 10 of the invention. The panel lamp 54 is configured to generate white light with a Correlated Color Temperature (CCT) of ≈3000K, an emission luminous intensity of order 800 lumens (lm) and an emission angle of order 120°.

The panel lamp 54 comprises an enclosure (housing) 56 which in the example shown is in the form of a shallow square tray with sides of length 50 cm and a depth of order 2 cm. The panel lamp 54 is intended to be surface mounted on a ceiling, wall or other generally planar surface. It is also envisaged to incorporate the panel lamp 54 into a suspended (drop) ceiling of a type commonly used in offices and commercial premises in which a grid of support members (T bars) are suspended from the ceiling by cables and ceiling tiles are supported by the grid of support members. Typically suspended ceiling tiles are either square (60 cm×60 cm) or rectangular (120 cm×60 cm) in shape and the enclosure 56 can be readily configured to fit within such size openings. The enclosure 56 can be fabricated from sheet material such as aluminum; die cast or molded from for example a plastics material.

As illustrated in FIG. 8 the panel lamp 54 can be configured as a ceiling mountable fixture in which a base 58 of the enclosure 56 is mounted to a ceiling and light is emitted in a downward direction through the opening of the enclosure 56 which constitutes a light emission plane 60. Unless otherwise indicated relative positioning of components will be described with reference to the orientation shown in FIG. 8 such that the base 58 of the enclosure is at the top of the page and the light emission plane (enclosure opening) 60 is at the bottom.

The panel lamp 54 further comprises a respective LED lamp (edge lighting bar) 10 mounted along opposite side walls 62 of the enclosure 56. In the example shown in FIG. 8 the lighting bars 10 comprise those shown in FIGS. 1 and 2. Each edge lighting bar 10 is mounted with the base 12*c* of the lighting bar in contact with the wall 62 and the shorter wall 12*b* in contact the base 58 of the enclosure 58 such that each lighting bar emits light in a direction towards the enclosure base 58. The lighting bars 10 are preferably mounted in thermal communication with the enclosure to assist in dissipating heat generated by the lighting bar.

A planar light reflective scattering surface 64 is provided on the enclosure base 58 and substantially covers the surface area of the enclosure floor. The light reflective/scattering surface 64 comprise a white surface for example a painted surface including light reflective particles or a high reflectivity paper. The surface 64 scatters incident light uniformly in all directions. By randomizing the angle at which light is reflected from the surface this can assist in producing a uniform angular emission of light from the panel lamp 54.

To maximize emission of light from the lamp all of the inner surfaces of the enclosure, in particular the end walls, comprise light reflective and/or light scattering surfaces (not shown).

For ease of understanding only light paths 26 are indicated in FIG. 8 for light emitted by the right hand lighting bar. Moreover, only light paths are indicated that lie in a plane that is mutually orthogonal to the side wall 62 and base 58 though it will be appreciated that due to the angular emission pattern of the LEDs 14 other paths exist which will impinge on the light reflective scattering surface and end walls of the enclosure.

A particular advantage of the panel lamp 54 of the invention, compared with a conventional panel lamp that incorporates one or more fluorescent tubes, is that it can produce substantially uniform (i.e. a variation in intensity of less than ±10%) light emission intensity over the light emission plane 60. It will be appreciated that the edge lighting bars 10 of the invention ensure that the intensity of light over the light reflective/scattering surface 64 is substantially uniform though light will strike the surface at a range of angles. To ensure that the angular light emission from the panel lamp 54 is substantially uniform over the light emission plane 60 the light reflective/scattering surface randomizes the angle of reflection of light towards the emission plane. Additionally the panel lamp 54 of the invention has an overall thickness (height) "h" that is less than a conventional panel lamp.

In the embodiments described so far the LEDs 14 are white light emitting devices, "whites LEDs" and incorporate one or more phosphor materials. In further embodiments it is envisaged to provide one or more phosphor materials overlying and/or located at the light emission plane 60 such that it is physically remote to the solid state emitter (LED) used to excite the phosphor.

Figure 9:
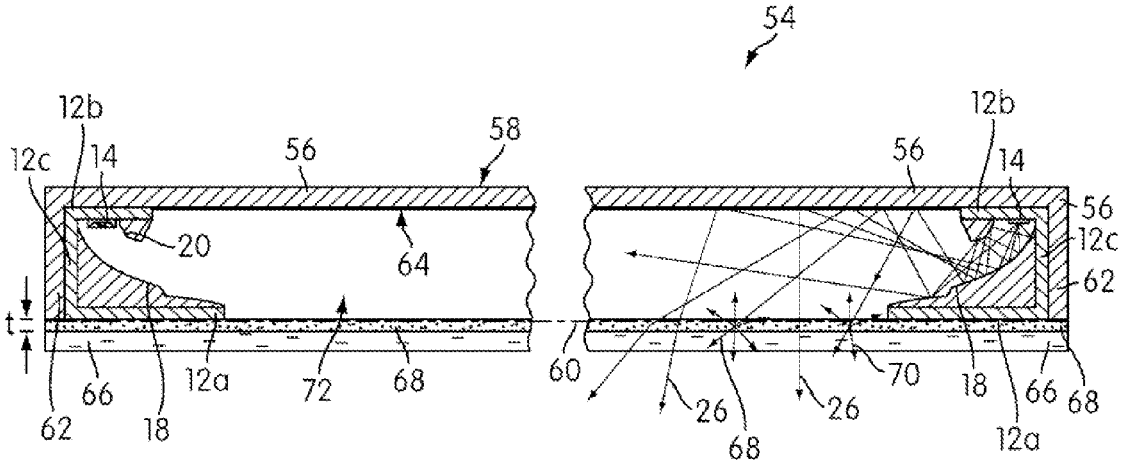
FIG. 9 is a sectional schematic of a light emitting panel lamp incorporating the lamp of FIG. 1.

A panel lamp in accordance with a further embodiment of the invention is now described with reference to FIG. 9 which shows a schematic sectional view of such a panel lamp 54. In this embodiment the LEDs 14 comprise blue (450-480 nm) light emitting 1.1 W GaN based LEDs and a light transmissive window (cover) 66 is provided at the emission plane and which includes one or more layers of one or more phosphor (photo luminescent) materials 68 for generating a required color and/or CCT of emitted light (typically white). As is known the one or more phosphor materials absorb a proportion of the blue light emitted by the LED and emit yellow, green and/or red light. The blue light that is not absorbed by the phosphor material(s) combined with light emitted by the phosphor material(s) gives an emission product that appears white in color. The phosphor material 68, which is typically in powder form, can be mixed with a binder material such as NAZDAR's clear screen ink 9700 and the mixture screen printed on the surface of the window to form a layer of uniform thickness "t". It will be appreciated that the phosphor can be applied by other deposition methods such as spraying, ink jet printing or by mixing the powdered phosphor with a light transmissive binder material such as an epoxy or silicone and applying the phosphor/polymer mixture by doctor blading, spin coating etc. To protect the phosphor material 68 the window 66 is preferably mounted with the phosphor layer(s) 68 located on the inside of the enclosure. Typically the weight loading of phosphor material to light transmissive binder in the deposited material is between 10% and 30% though it can range between 1% and 99% depending on the desired emission product. To deposit a sufficient density of phosphor material per unit area, for example 0.02-0.04 g/cm$^2$, it may be necessary to make multiple print passes, the number of passes depending on the mesh size of the printing screen.

The phosphor material(s) can comprise an inorganic or organic phosphor such as for example silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in our co-pending United States patent application Publication No. US 2007/0029526 A1 "Silicate-based orange phosphors" and U.S. Pat. No. 7,311,858 B2 "Silicate-based yellow-green phosphor", U.S. Pat. No. 7,575,697 B2 "Silicate-based green phosphors" and U.S. Pat No. 7,601,276 B2 "Two-phase silicate-based yellow phosphor" (all assigned to Intematix Corporation) the entire content of each of which is incorporated herein by reference. The phosphor can also comprise an aluminate-based material such as is taught in our co-pending United States patent application Publication No. US 2006/0158090 A1 "Novel aluminate-based green phosphor" and U.S. Pat. No. 7,390,437 B2 "Aluminate-based blue phosphor", an aluminum-silicate phosphor as taught in co-pending patent application Publication No. US 2008/0111472 A1 "Aluminum-silicate based orange-red phosphor with mixed divalent and trivalent cations" or a nitride-based red phosphor material such as is taught in our co-pending patent applications Publication No. US 2009/0283721 A1 "Nitride-based red phosphors" and Ser. No. 12/632,550 filed Dec. 7, 2009 the entire content of each of which is incorporated herein by reference. It will be appreciated that the phosphor material is not limited to the examples described herein and can comprise any phosphor material including nitride and/or sulfate phosphor materials, oxy-nitrides and oxy-sulfate phosphors or garnet materials (YAG).

An advantage of providing the phosphor remote to the LEDs is that light generation, photo-luminescence 70, occurs over the entire surface of the window 66 (light emission plane 60) and this can result in a more uniform color and/or CCT of emitted light. Due to the isotropic nature of phosphor photo-luminescence approximately half of the light 70 generated by the phosphor will be emitted in a direction back into the volume 72 of the lamp enclosure. Such light will be reflected by the light reflective/scattering surface 64 and eventually emitted through the light emission plane 60. It will be further appreciated that light will be scattered by the phosphor material(s) 68.

A further advantage of locating the phosphor physically remote to the LEDs is that less heat is transferred to the phosphor material(s), reducing thermal degradation of the phosphor material(s). Additionally the color and/or CCT of the panel lamp 54 can be changed by changing the phosphor/polymer window 66.

In yet a further arrangement the phosphor material(s) 68 can be incorporated within the window 66. In such an arrangement the powdered phosphor material(s) can be mixed polymer material (for example a polycarbonate, acrylic, silicone, epoxy material) or a low temperature glass and the mixture then formed, by for example extrusion, as a sheet of uniform thickness that has a uniform (homogeneous) distribution of phosphor throughout its volume. The weight ratio loading of phosphor to window material is typically in a range 35 to 85 parts per 100 with the exact loading depending on the required CCT of the emission product of the lamp. As in the case of the weight loading of the phosphor to polymer, the thickness of the phosphor loaded window 66 will determine the CCT of light generated by the lamp.

Moreover as disclosed in co-pending United States patent application Publication No. US 2009/0101930 A1 "Light emitting device with phosphor wavelength conversion", the entire content of which is incorporated herein by reference, the phosphor material(s) can be patterned such as to include a pattern of windows (i.e. areas with no phosphor material) which are transmissive to light generated by the LEDs and light generated by the phosphor. Such an arrangement can increase overall light emission from the lamp 54. For example the phosphor material can be provided as a checkered pattern of two different phosphor materials (e.g. green and red light emitting phosphors). In other arrangements the phosphor material can be provided as a square array of square shaped phosphor regions that are separated from one another other by a window in the form of a square grid. In another arrangement it is envisaged to provide the phosphor material as a layer covering the entire surface of the light transmissive window 66 and which includes a regular array (e.g. square or hexagonal array) of circular or other shaped windows. Other phosphor patterns will be apparent to those skilled in the art.

To increase the CRI (Color Rendering Index) of the lamp it is envisaged to further include one or more red (600 to 700 nm) light emitting diodes.

Figure 10:
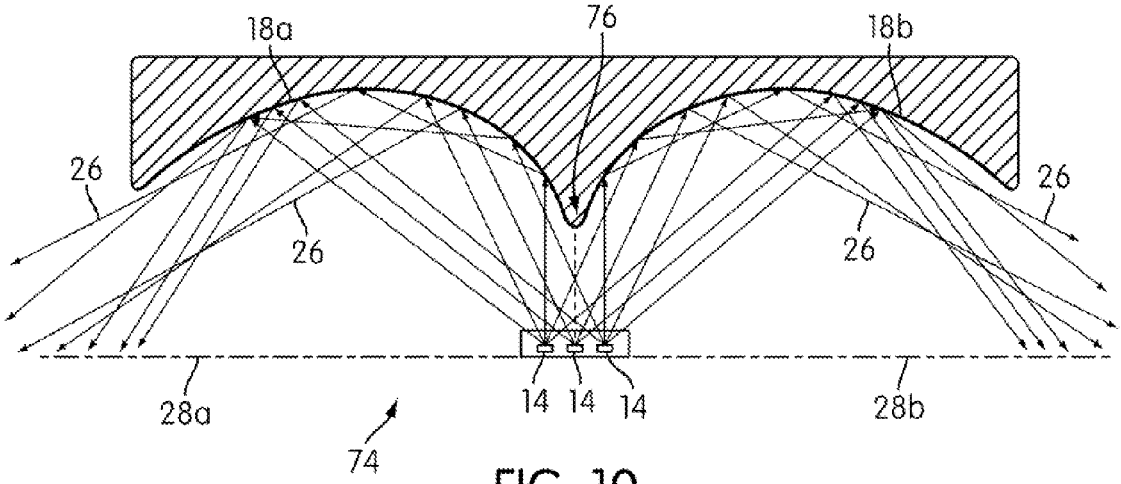
FIG. 10 is a sectional schematic of an LED-based lamp in accordance with another embodiment of the invention.

FIG. 10 is a sectional schematic of an LED-based lamp 74 in accordance with another embodiment of the invention. The lamp 74 is configured to emit light over a respective illumination plane 28*a*, 28*b* located along opposite edges of the lighting bar. Since the lamp produces uniform illumination over planes located along both edges of the lamp, the lamp will be referred to as a center lamp or center lighting bar 74. In this embodiment the light reflective surface comprises two symmetrical concave cylindrical surfaces 18*a*, 18*b* whose edges abut along their length to form a ridge 76 running the length of the lighting bar. The LEDs 14 are located along the length of the lighting bar with their principal emission axis 16 orthogonal to the ridge 74. As can be seen in FIG. 10 the light reflective surfaces 18*a*, 18*b* are configured such that light emitted on a first side of the principal axis 16 is emitted over the illumination plane located on the same side of the lighting bar. For example the light reflective surface 18*a* is configured to direct light over the illumination plane 28*a* whilst the light reflective surfaces 18*b* is configured to direct light over the illumination plane 28*b*.

A particular benefit of the center lighting bar 74 of the invention is that in combination with the edge lighting bars 10 it enables the construction of low profile panel lamps of virtually any size such as are required for large format billboards and advertising signage.

Figure 11:
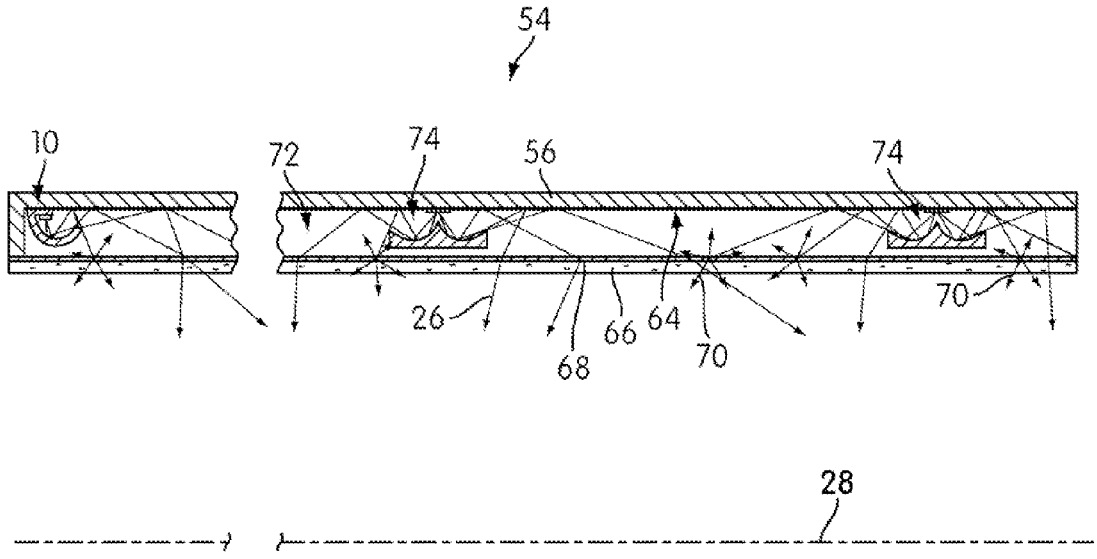
FIG. 11 is a sectional schematic of a light emitting panel lamp incorporating the lamps of FIGS. 6 and 10.

FIG. 11 is a sectional schematic a sectional schematic of a light emitting panel lamp 54 based on edge lighting bars 10 and center lighting bars 74.

Figure 12:
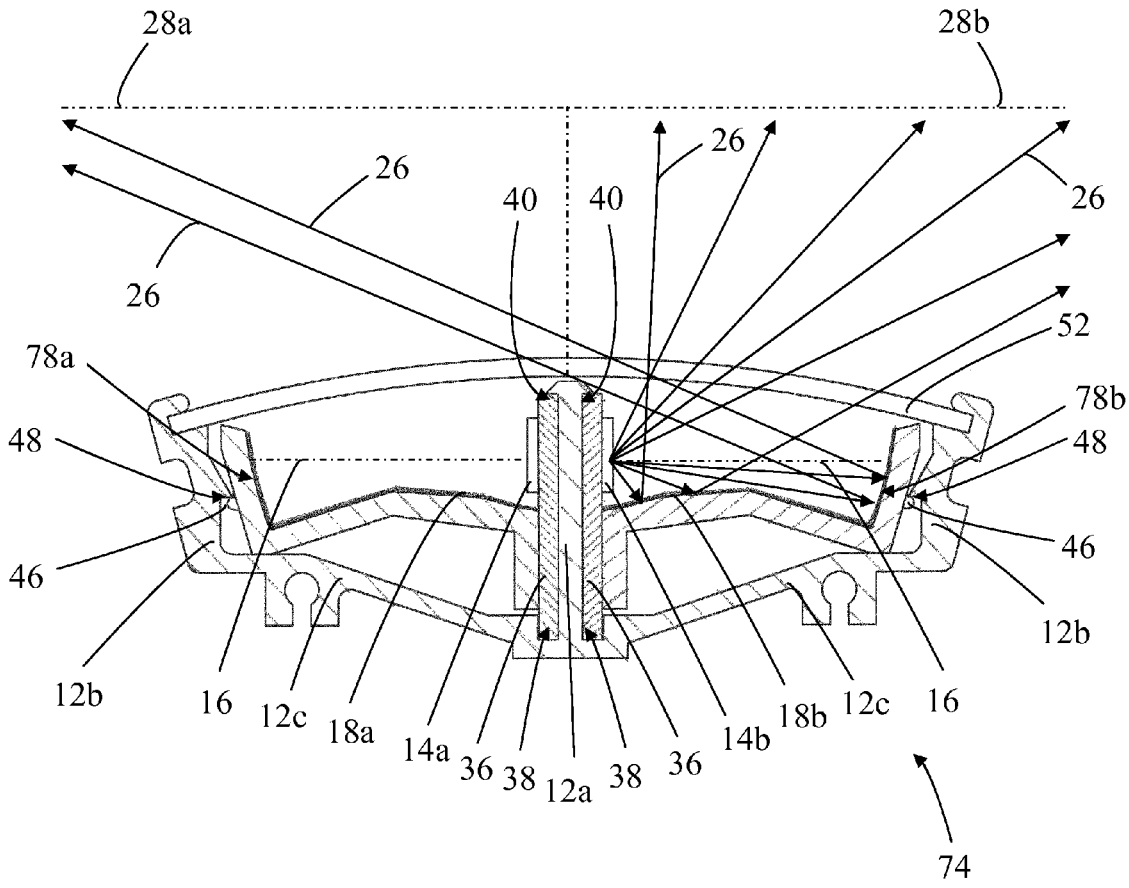
FIG. 12 is a sectional view of an LED-based lamp in accordance with yet another embodiment of the invention.
Figure 13:
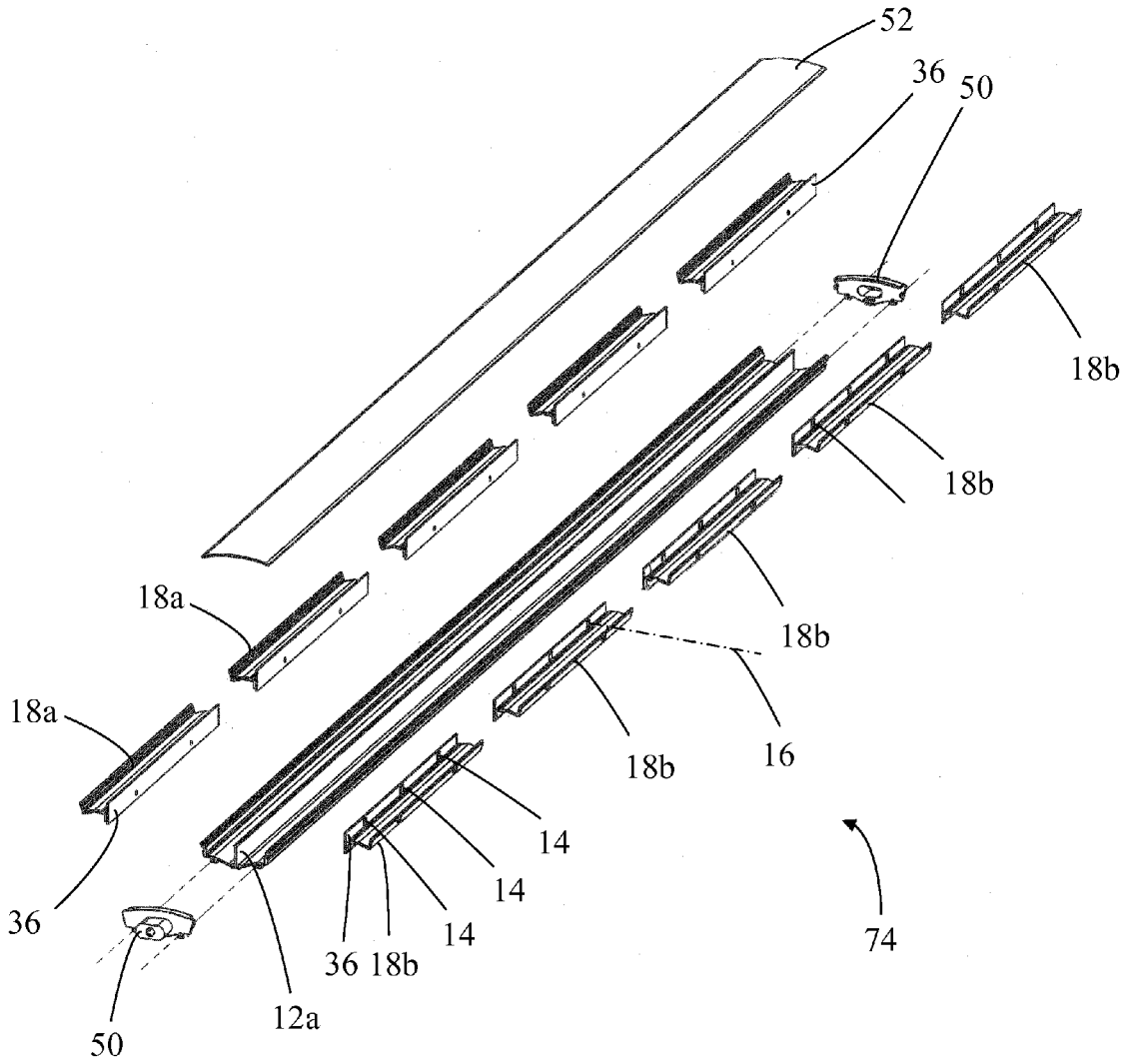
FIG. 13 is an exploded perspective of the lamp of FIG. 12.

FIGS. 12 and 13 respectively show a sectional view and an exploded perspective view of a center lighting bar 74 in accordance with a further embodiment of the invention. In this embodiment the center lighting bar 74 generally comprises two of the edge lighting bars 10 shown in FIGS. 4 and 5 in which the body 12 comprises two U-shaped channels with a common central wall 12*a*. To eliminate a dark region at the illumination plane 28 corresponding to the central wall 12*a* each light reflective surface 18*a*, 18*b* can, as shown, include a respective portion 78*a*, 78*b* that is configured to direct light over the illumination plane 28*b*, 28*a* along an opposite edge of the lighting bar, that is the light reflective portion 78*a* is configured to direct light from the LEDs 14*a* over the illumination plane 28*b* and the light reflective portion 78*b* is configured to direct light from the LEDs 14*b* over the illumination plane 28*a*. As shown in FIG. 13 the lighting bar 74 can be of a modular construction and composed of LED bar/reflector assemblies 14, 18 of a standard length. For example as shown a 5 foot center lighting bar 74 can be composed of ten 1 foot LED bar/reflector assemblies.

Figure 14:
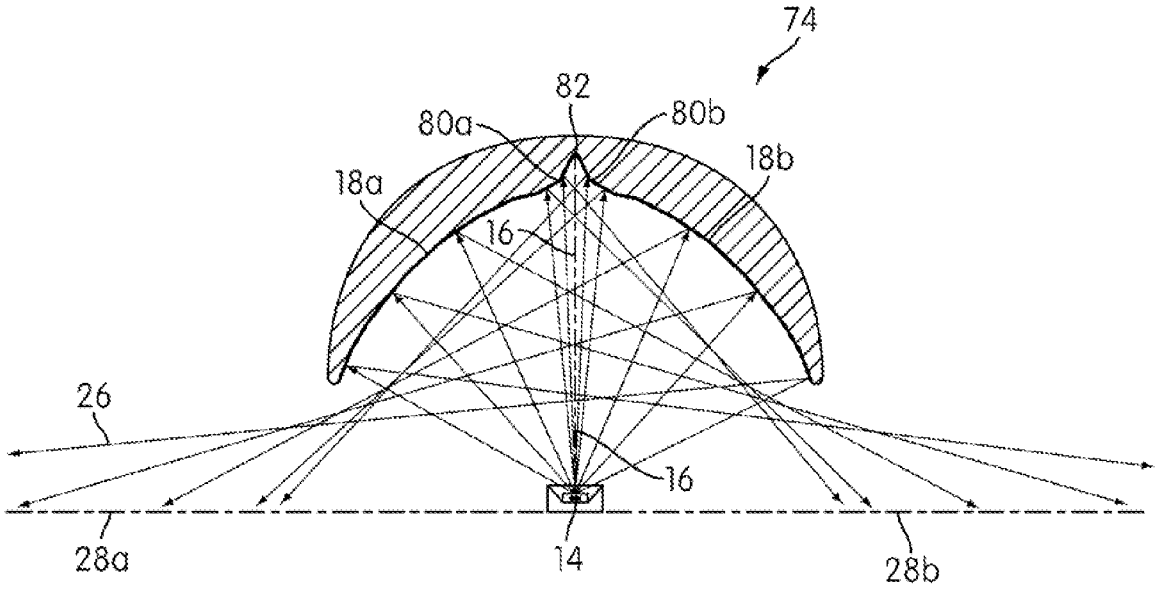
FIG. 14 is a sectional schematic of an LED-based lamp in accordance with a further embodiment of the invention.

FIG. 14 is a sectional schematic of a lighting bar 74 in accordance with of further embodiment of the invention. In this embodiment the symmetrical light reflective surfaces 18*a*, 18*b* are multi-faceted and generally concave in form. Each surface 18*a*, 18*b* further comprises a convex portion 80*a*, 80*b* located where the two surfaces abut such that the junction of the surfaces define a generally "v" shaped groove 82 running the length of the lighting bar. The LEDs 14 are located along the length of the lighting bar with their principal emission axis 16 orthogonal to the groove 82. As can be seen in FIG. 14 the light reflective surfaces 18*a*, 18*b*, 80*a*, 80*b* are configured such that light emitted on a first side of the principal axis 16 is emitted over the illumination plane on the opposite side of the lighting bar. For example the light reflective surfaces 18*a*, 80*a* are configured to direct light over the illumination plane 28*b* whilst the light reflective surfaces 18*b*, 80*b* are configured to direct light over the illumination plane 28*a*.

It will be appreciated that LED-based lamps in accordance with the invention finds application wherever it is required to produce a uniform illumination with a high aspect ratio (i.e. w:d illumination width at illumination plane:distance of light source from illumination plane). For example it is envisaged to use the panel lamps 54 as a back-light (light box) of a light emitting sign in which a display surface is provided at the light emission plane 60. The display surface can comprise a printed surface or letters, numerals, devices or other information in the form of light transmissive colored filters.

In other arrangements the back-light 54 can generate blue light and the display surface further comprise one or more phosphor materials that are provided as a pattern to generate the required light emitting indicia or symbols. Examples of such signs include light emitting exit signs, pedestrian crossing "walk" and "stop" signs, traffic signs, advertising signage (billboards) etc. Examples of back-lit light emitting signs are disclosed in our co-pending United States patent application Publication No. US 2007/0240346 A1 "Light emitting sign and display surface therefor" the entire content of which is incorporated herein by reference.

In yet further embodiments one or more lighting (edge or center) bars in accordance with the invention can be used to front light a display surface such as for example a real estate sign.

The lamps and light emitting sign of the invention are not restricted to the specific embodiment described and variations can be made that are within the scope of the invention. For example, lamps in accordance with the invention can comprise other solid state light emitters such as silicon carbide (SiC), zinc selenide (ZnSe), indium gallium nitride (InGaN), aluminum nitride (AlN) or aluminum gallium nitride (AlGaN) based LED chips that emit blue or U.V. light.

What is claimed is:

1. A lamp comprising:

a plurality of solid state light emitters configured as an elongate array; and a first generally concave cylindrical light reflective surface disposed along a length of the array of light emitting devices and configured to direct light over an illumination plane located to a side of the lamp;

an elongate channel shaped body in which the light emitters are located within and spaced along the length of the body;

wherein the body comprises a base portion, a first wall portion, and a second wall portion, and the concave light reflective surface extends between the base portion and the first wall portion;

wherein the light emitters extend along the second wall portion; and a substantially convex light reflective cylindrical surface located within the body and extending along the second wall portion and configured such that in operation the concave and convex light reflective surfaces direct light over the illumination plan.

2. The lamp according to claim 1, and further comprising a second generally concave cylindrical light reflective surface in which the concave light reflective surfaces are configured to direct light over an illumination plane located on respective sides of the lamp.

3. The lamp according to claim 1 or claim 2, wherein the solid state light emitters are configured such that their emission axis is at an angle to the illumination plane of between 0° and 90°.

4. The lamp according to claim 2, wherein the concave light reflective surfaces abut to form a ridge which is configured to extend toward and overlay the array of light emitters.

5. The lamp according to claim 2, wherein each concave light reflective surface comprises a convex portion and wherein the convex portions abut to form a generally "v" shaped groove which is configured to overlay the array of light emitters.

6. The lamp according to claim 1 or claim 2, wherein the concave light reflective surface is one of being multi-faceted, a continuously curved surface and a combination thereof.

7. The lamp according to claim 1 or claim 2, wherein the concave light reflective surfaces are configured such that a variation in luminous emission intensity over the illumination plane is less than 10%.

8. The lamp according to claim 1, wherein the concave light reflective surface comprises an integral surface of the body.

9. The lamp according to claim 8, wherein the concave light reflective surface comprises an inner surface of the base portion and the first wall portion of the body.

10. The lamp according to claim 1, wherein the light reflective surfaces have a reflectance selected from the group consisting of: at least 90%, at least 95% and at least 98%.

11. A panel lamp comprising an enclosure and incorporating at least one lamp according to claim 1 or claim 2.

12. The panel lamp according to claim 11, wherein the at least one lamp is located in the enclosure and configured to emit light towards the enclosure opening.

13. A panel lamp comprising:

an enclosure including a base; and at least one lamp including a plurality of solid state light emitters configured as an elongate array, a first generally concave cylindrical light reflective surface disposed along a length of the array of light emitting devices, and a second generally concave cylindrical light reflective surface disposed along a length of the array of light emitting devices, wherein the first and second concave light reflective surfaces are configured to direct light over an illumination plane located on respective sides of the lamp;

wherein the at least one lamp is located in the enclosure and configured to emit light towards the base of the enclosure.

14. The panel lamp according to claim 13, and further comprising a light reflective surface on the base of the enclosure.

15. The panel lamp according to claim 14, wherein the light reflective surface on the base of the enclosure further comprises a light scattering surface.

16. The panel lamp according to claim 15, wherein the enclosure is quadrilateral in form and a respective lamp is located adjacent opposite walls of the enclosure and wherein the light reflective scattering surface comprises a convex cylindrical surface that extends between the walls of the enclosure at which the lamps are located.

17. The panel lamp according to claim 15, wherein the enclosure is quadrilateral in form and lamps are located adjacent opposite walls of the enclosure and wherein the light reflective scattering surface comprises a substantially planar surface that extends between the walls of the enclosure at which the lamps are located.

18. A panel lamp comprising:

an enclosure; and at least one lamp including a plurality of solid state light emitters configured as an elongate array and a first generally concave cylindrical light reflective surface disposed along a length of the array of light emitting devices and configured to direct light over an illumination plane located to a side of the lamp; and at least one phosphor material operable to absorb at least a portion of light emitted by the light emitters and to emit light of a different wavelength range, wherein the at least one phosphor material is provided at the enclosure opening.

19. The panel lamp according to claim 18, and further comprising a light transmissive window overlying the enclosure opening and wherein the at least one phosphor material is incorporated in the light transmissive window.

20. The panel lamp according to claim 19, wherein the at least one phosphor material is distributed substantially uniformly throughout the volume of the light transmissive window.

21. The panel lamp according to claim 19, and further comprising a light transmissive window overlying the enclosure opening and wherein the at least one phosphor material comprises at least one layer on at least a part of the surface of the light transmissive window.

22. The panel lamp according to claim 20 or claim 21, wherein the light transmissive window is selected from the group consisting of being: substantially planar and arcuate in form.

23. A light emitting sign comprising a light transmissive display surface and at least one lamp according to claim 1 or claim 2 that is configured to illuminate the display surface.

24. A light emitting sign comprising a light transmissive display surface and at least one lamp that is configured to illuminate the displace surface;

wherein the at least one lamp includes a plurality of solid state light emitters configured as an elongate array and a first generally concave cylindrical light reflective surface disposed along a length of the array of light emitting devices and configured to direct light over an illumination plane located to a side of the lamp; and at least one phosphor material operable to absorb at least a portion of light emitted by the light emitters and to emit light of a different wavelength range, wherein the at least one phosphor material is located on the display surface.

25. The sign according to claim 24, wherein the display surface is light transmissive and the at least one phosphor material is provided as one or more layers on the display surface.

26. The panel lamp according to claim 18, wherein the at least one lamp further includes a second generally concave cylindrical light reflective surface in which the concave light reflective surfaces are configured to direct light over an illumination plane located on respective sides of the lamp.

27. The panel lamp according to claim 24, wherein the at least one lamp further includes a second generally concave cylindrical light reflective surface in which the concave light reflective surfaces are configured to direct light over an illumination plane located on respective sides of the lamp.

* * * * *